US005937925A

United States Patent [19]

Lee

[11] Patent Number: 5,937,925

[45] Date of Patent: Aug. 17, 1999

[54] METHOD FOR MANUFACTURING A HIGH STRENGTH LUMBER

[76] Inventor: Young-Hee Lee, 4/203 Samsung Apt, Taejun-Dong, Buk-Gu, Daegu, Rep. of Korea

[21] Appl. No.: 09/075,183

[22] Filed: May 11, 1998

[51] Int. Cl.[6] ..... B27M 1/00

[52] U.S. Cl. ..... 144/380; 144/329; 144/359; 144/364; 144/361; 34/382; 34/388; 428/114; 428/537.1

[58] Field of Search ..... 144/359, 364, 144/380, 329, 361; 34/382, 388, 389; 428/105, 106, 113, 537.1, 114, 98, 108, 109

[56] References Cited

U.S. PATENT DOCUMENTS 4,469,156 9/1984 Norimoto et al. ..... 144/380
4,672,006 6/1987 McGraw ..... 144/380
5,088,533 2/1992 Binder ..... 144/380
5,343,923 9/1994 Tanahashi et al. ..... 144/380
5,685,353 11/1997 Viitaniemi et al. ..... 144/380

*Primary Examiner*—W. Donald Bray
*Attorney, Agent, or Firm*—Birch, Stewart, Kolasch & Birch, LLP

[57] ABSTRACT

A method for manufacturing a high strength lumber obtained by artificially compressing a volume of grown natural wood without any destruction of wood tissue, and which is made such that a pine tree is lumbered and exposed to a microwave whereby moisture content is forcibly discharged and cellulose is softened and thereby volume is constricted up to more than 70% by a hydraulic press during a latent heat is still present, so that a high strength lumber is obtained without any destruction of lumber tissue and due to this, a strength and hardness are improved about 30 times of original wood and a tensile strength is increased about up to 10 times of original wood.

6 Claims, 3 Drawing Sheets

METHOD FOR MANUFACTURING A HIGH STRENGTH LUMBER

BACKGROUND OF THE INVENTION

The present invention relates to a method for manufacturing high strength lumber in which natural lumber is exposed to microwave energy, whereby moisture content is vaporized and evaporated. Cellulose tissue in the wood is also softened and then compressed so that its volume is constricted up to more than 70% of its original volume without destroying the lumber tissue, thereby producing high strength lumber.

SUMMARY OF THE INVENTION

Although various kind of wood may be used for lumber, the present invention is a method for manufacturing high strength lumber especially using pine, which is economically high in effective value as a sample.

A principal ingredient of pine (or any wood) is cellulose, water contained within tracheas in the cellulose, and resin, and in case when water contained within the tracheas is eliminated, cavities are produced which occupy more than 70% of whole volume of the wood.

As shown in FIG. 1, since the wood is tracheal structure 1 of late wood and early wood is different, drying causes difference of a strain due to difference of thermal expansion and contraction.

However, since the structure of the cellulose 2, as shown in FIG. 2, is uniformly set in longitudinal and lateral directions, it can be understood that strain of cellulose itself does not occur.

In pine wood tissue having such a structure, the tracheas 1 are compressed in volume when the cellulose 2 is pressed after completely eliminating the water molecules within the tracheas 1. The volume of the wood can be constricted up to more than 70%, and the constricted material is made into lumber as an aggregation of compressed cellulose tissue.

Accordingly, thus made compressed lumber is stable and has no deformation. It becomes about 30 times stronger than original uncompressed wood in terms of strength and hardness.

In order to realize the foregoing according to the present invention includes a method for exposing wood having moisture content to a microwave energy (for example, 500 W of power at a frequency of 2,450 MHz) and eliminating (by evaporating) the moisture content, thereby softening the cellulose in the wood. The present invention also includes compressing the cellulose while a latent heat is still present.

DETAILED DESCRIPTION OF THE INVENTION

Hereinafter, the present invention will be described in further detail with reference to the accompanying drawings.

Figure 1:
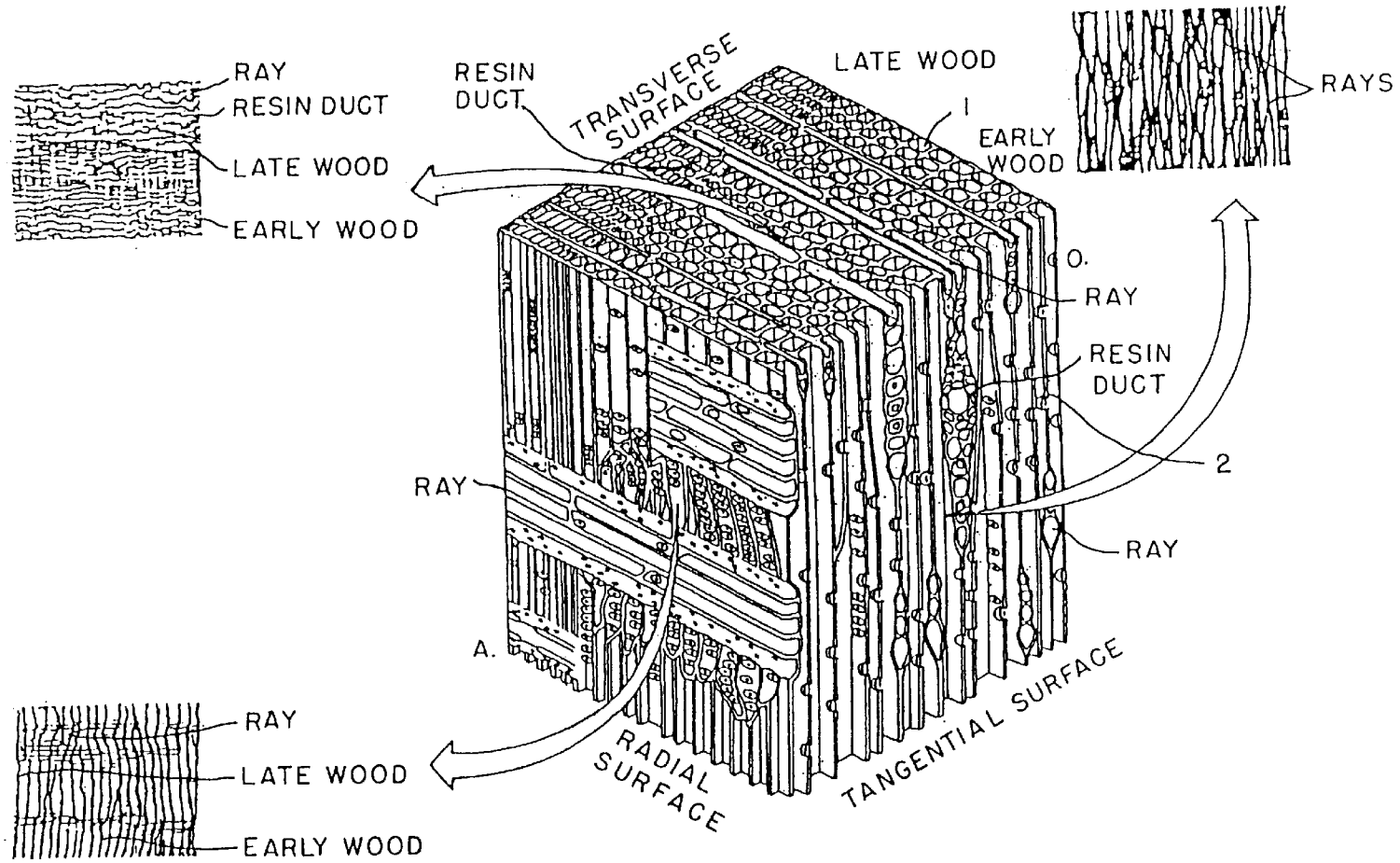
FIG. 1 is a view of pine wood tissue.
Figure 2:
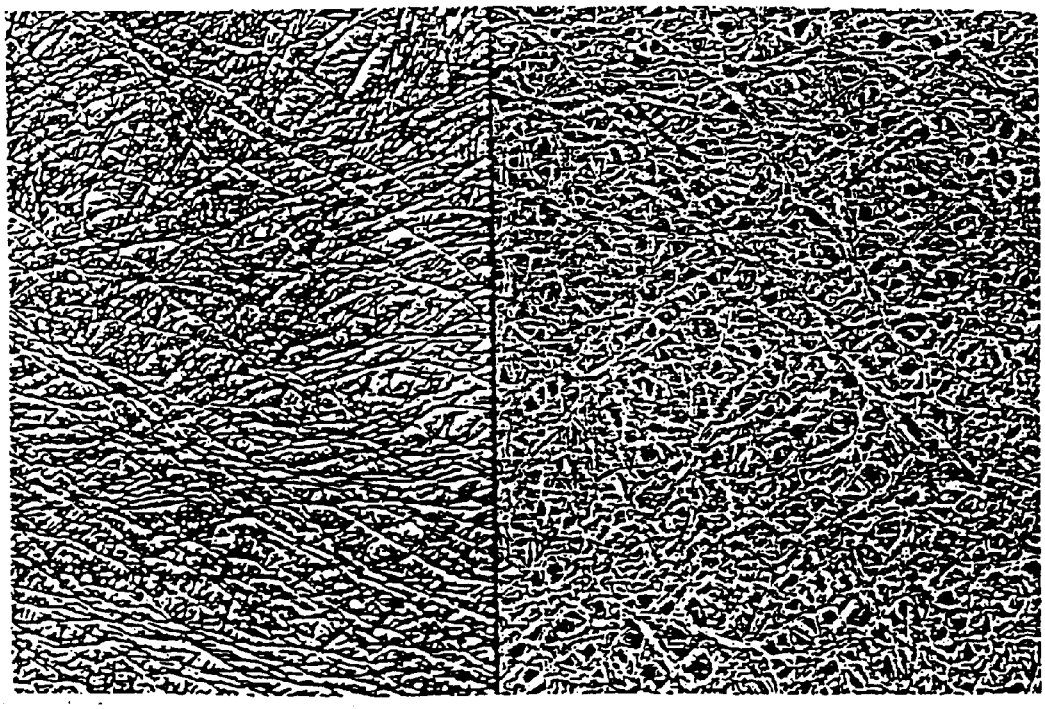
FIG. 2 is a fragmentary magnified view of cellulose tissue existing between tracheas.
Figure 3:
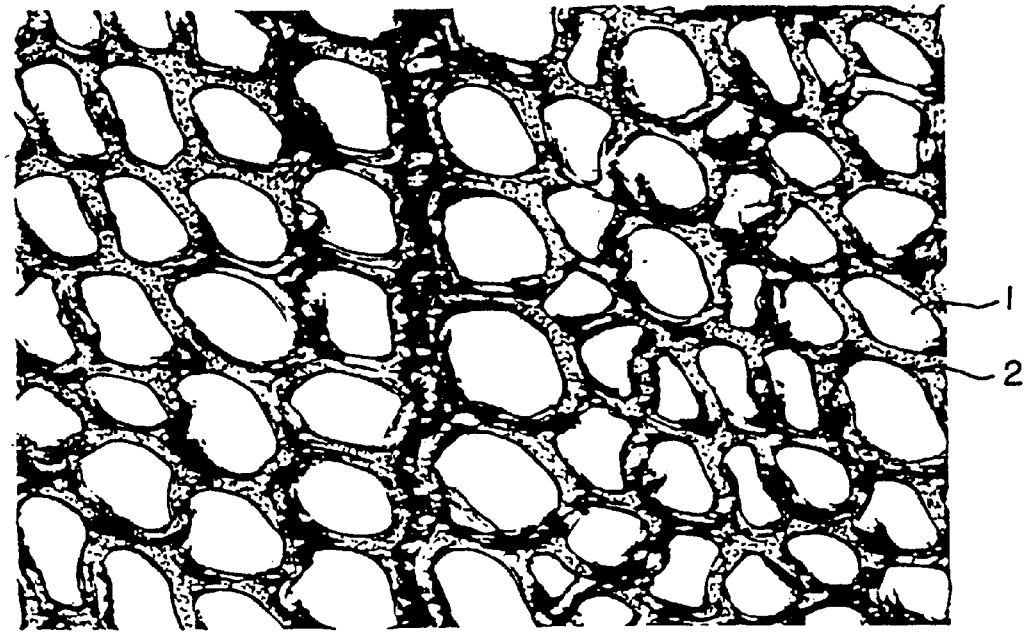
FIG. 3 is a fragmentary magnified view of tissue from a lateral cross section of compressed pine wood.

FIG. 1 shows pine wood tissue.

The present invention obtains high strength lumber by humidifying pine wood to a predetermined level, exposing the humidified pine wood microwave energy, forcibly eliminating water from within the tracheas 1 of the pine wood thereby, making the cellulose tissue soft, and compressing the softened cellulose using a hydraulic press while latent heat is still present therein so as to compress the cellulose volume by at least 70%.

Since the moisture molecules within the wood resonantly vibrate because of the microwave energy at least free vibration frequency of water molecules the water evaporates from the wood and is discharged to the exterior through spaces among the cellulose tissues. Therefore, the wood is dried without destroying pine wood tissue and becomes lumber by emptying the tracheal structure 1, and internal latent heat energy present at this time is transferred to cellulose tissue, whereby the cellulose tissue 2 forming the tracheal walls is made soft.

Figure 4:
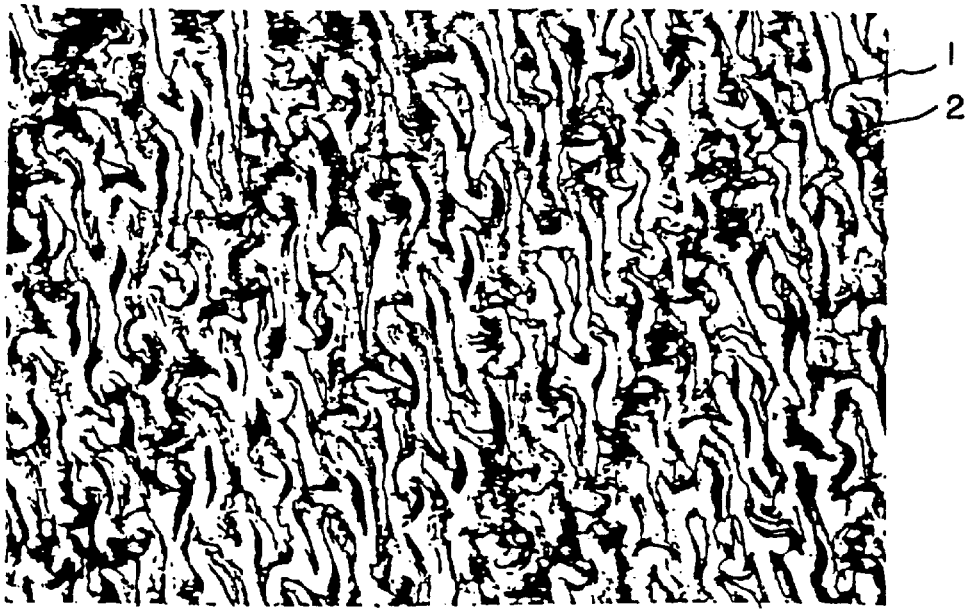
FIG. 4 is a fragmentary magnified view of tissue of lateral cross section from a compressed pine wood.

Thereafter, by when applying about 2.5 tons of hydraulic pressure, the softened cellulose tissue is compressed and the tracheas 1 are constricted so that compressed tissue as seen in FIG. 4 can be obtained.

However, if latent heat within the wood dissipates after eliminating water with microwave energy, the cellulose is solidified and re-structured, so the tracheal walls are structured stronger than original. Thereafter, when an external pressure is applied, the tracheal structure is destroyed whereby the value of the lumber is lost. Therefore, material of desired strength and hardness can not be obtained.

Accordingly, the softened wood material should be rapidly latent heat is present, for example, within 60 seconds.

Figure 5:
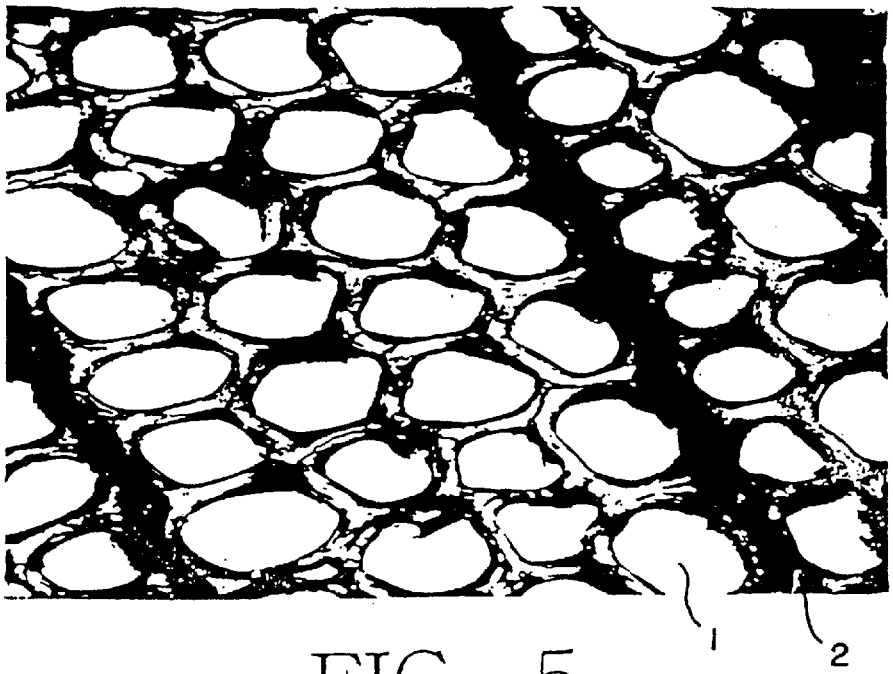
FIG. 5 is fragmentary magnified view of tissue from lateral cross section which restored the compressed pine wood.

When compressed lumber is made by such a method, the volume of the lumber can be reduced more than 70% relative to the volume of the original lumber. Once the constriction is made, deformation does not occur without exterior artificial fabrication. Since lumber strength and hardness can be controlled in accordance with the amount of constriction, lumber constricted maximally is about 30 times stronger than the original lumber. Only tensile strength can be increased by up to 10 times, but also an interior structure of the original lumber is not entirely broken (because only deformation is made). When the compressed lumber is submerged in water, a slow restoration to original (refer to FIG. 5) lumber is possible, so it is possible to manufacture useful lumber suitable for usage. Therefore, lumber capable of being usefully used as a new material in an industrial field, as well as construction material, is obtained.

What is claimed is:

1. A method for manufacturing lumber from wood, comprising exposing the wood to microwave energy so that moisture in the wood is evacuated therefrom, thereby softening the wood; and compressing the softened wood while latent heat energy from said step of exposing the wood to microwave energy is still present therein, thereby reducing the volume of the softened wood.

2. The method according to claim 1, wherein the wood is pine wood.

3. The method according to claim 1, further comprising a step of humidifying the wood, prior to said step of exposing the wood to microwave energy.

4. The method according to claim 1, wherein said compressing step comprises compressing the softened wood to 70% of an original volume of the wood, prior to said compressing step.

5. The method according to claim 1, wherein said exposing step comprises exposing the wood to 500 W of microwave energy at an oscillating frequency of 2450 MHz.

6. The method according to claim 1, wherein said step of compressing the softened wood comprises compressing the softened wood under 2.5 tons of force.

* * * * *